United States Patent [19]

Thomas

[11] Patent Number: 4,939,833

[45] Date of Patent: Jul. 10, 1990

[54] DOUBLE CONTAINMENT AND LEAK DETECTION APPARATUS

[75] Inventor: Horace F. Thomas, Houston, Tex.

[73] Assignee: CoreTank, Inc., Houston, Tex.

[21] Appl. No.: 388,593

[22] Filed: Aug. 2, 1989

[51] Int. Cl.[5] ..... B65D 90/04; B65D 90/24

[52] U.S. Cl. ..... 29/401; 29/402.16; 29/455.1; 73/49.2; 137/312; 220/5 A; 220/457; 220/466

[58] Field of Search ..... 29/401.1, 402.01, 407, 29/428, 455.1, 460, 402.16; 73/49.2; 116/206, 266; 137/312; 220/1 B, 5 A, 441–443, 457, 465, 466, DIG. 16

[56] References Cited

U.S. PATENT DOCUMENTS

| | | | |
|---|---|---|---|
| 2,220,186 | 11/1940 | Walker | 220/1 B |
| 3,383,004 | 5/1968 | Closner | 220/5 A |
| 3,828,608 | 8/1974 | Yamamoto | 73/49.2 |
| 3,902,356 | 9/1975 | Rupf-Bolz | 73/49.2 |
| 3,908,468 | 9/1975 | Katsuta et al. | 73/49.2 |
| 4,413,503 | 11/1983 | Olivieri | 73/49.2 |
| 4,537,328 | 8/1985 | Keesee et al. | 73/49.2 |
| 4,682,492 | 7/1987 | Green | 73/49.2 |
| 4,711,296 | 12/1987 | Nunlist | 220/457 |
| 4,765,178 | 8/1988 | Kempf et al. | 73/49.2 |

FOREIGN PATENT DOCUMENTS

| | | | |
|---|---|---|---|
| 2128209 | 1/1973 | Fed. Rep. of Germany | 220/457 |

*Primary Examiner*—Jimmy G. Foster

*Attorney, Agent, or Firm*—Harrison & Egbert

[57] ABSTRACT

A double containment and leak detection apparatus including a tank, having a bottom and a surrounding shell, with a containment baffle means above the bottom and a leak detection means in a containment space between the containment baffle means and the tank bottom. The containment baffle means includes a baffle plate sealingly joined to the interior of the shell to form a sealed containment space between the containment baffle and the bottom. The leak detection means is installed in the containment space to detect the presence of stored material held in the tank in the event such material leaks into the containment space. The leak detection means is connected, through a leak-proof access, to means external to the tank for responding to such leaks of stored material so detected inside the containment space. The invention further includes a primary containment means, made of liner material, located inside the tank above the containment baffle means and within the shell, capable of containing such stored material. The invention further provides a method for converting existing tanks to incorporate the double containment and leak detection apparatus of the present invention into existing facilities.

10 Claims, 3 Drawing Sheets

DOUBLE CONTAINMENT AND LEAK DETECTION APPARATUS

BACKGROUND OF THE INVENTION

The present invention relates to means for containing and detecting leaks in storage tanks. More particularly, the present invention relates to apparatus, and methods for constructing such apparatus, for containing leaks of hazardous, polluting, or otherwise undesirable fluids or solids from storage tanks, and for quickly detecting and signaling the presence of such leaks, thereby minimizing the dangers posed by storing such fluids and solids and complying with regulations requiring such containment and detection.

Storage of hazardous liquids and solids used in numerous industries requires storage tanks of all sizes. Chemical process plants, refineries, oil and gas production sites, manufacturing plants, and the like require storage of a variety of materials for processes used in such facilities. The materials so stored, whether gases, liquids, or solids, may include chemicals and compounds that could endanger the environment or pose significant health risks in the event of leakage into areas surrounding these storage systems. Heightened awareness in recent years over the quality of the environment has increased and tightened the rules, regulations, and requirements governing storage of such materials. Growing concern with public health issues has further emphasized the need to prevent leakage of hazardous materials into the environment to prevent, for instance, contaminating drinking water or exposing humans or wildlife to hazardous compounds.

Among the regulations governing the storage discussed above, by way of example, are the rules promulgated by the Environmental Protection Agency ("EPA") for hazardous waste management systems. See. e.g., 40 C.F.R. §§260–65 and §268 (1988). The EPA rules govern, among other matters, tank systems that store hazardous wastes. Id., §260.10. Hazardous wastes subject to these regulations include a host of residues, byproducts, and wastes that are generated or used in any of a lengthy list of chemical, manufacturing, and other processes. Id., §§261.3-ff. Under these regulations, what is designated "secondary containment" must be provided on all new tank systems storing hazardous wastes, and on existing hazardous waste systems as of various effective dates subsequent to Jan. 12, 1987. See id., §264.193 and §265.193. (Although reference is made in the present application to EPA regulations and the definitions used in those regulations, those definitions are not intended to, and do not, generally govern the use of terms in this application. Except as may be expressly noted to the contrary, all terms used in this application are to have their common and accepted meanings.)

An acceptable secondary containment system under these EPA regulations must, in general terms, be capable of collecting and accumulating liquids that leak from a tank and detecting such a leak or the presence of the accumulated liquids in this system within twenty-four hours. Id. As can be seen, therefore, the EPA regulations, as well as increasing safety and health concerns, have imposed stringent requirements for containing and detecting leakage of hazardous materials from storage tank systems. Effective, economical, and safe double containment and leak detection systems, therefore, are not only desirable but also mandatory, both for new and existing tank systems.

The cost of building new systems or converting old systems to comply with the EPA regulations could be astronomical if not performed with a minimum of alteration to tank systems built under previous requirements. Prior attempts at meeting the EPA regulations have encountered problems and proven unsatisfactory, for a variety of reasons. For example, various plastic liners, both internal and external, have been used in trying to meet the secondary containment requirement of the EPA regulations. Such liners, however, have split at their seams and would lead to contamination of the soil in the event of external tank leaks. The contaminated soil then has to be removed and disposed, which requires either removing the tank bottom or lifting the entire tank, to permit digging up the soil. This process of lifting or dismantling the tank and removing soil (which generally needs to be replaced) is very expensive and time-consuming. Another unsuccessful attempt to meet the EPA secondary containment regulations has utilized double-walled and double-bottom tanks, generally made of steel, with the annular space between the walls and bottoms filled with sand or other filler material. This latter technique has also proven to be unacceptable, because it fails to allow for removing, cleaning, and disposing the filler material should a leak occur.

It can be seen, therefore, that a need exists for meeting EPA regulations and satisfying environmental and safety concerns in general by providing economical, effective, and reliable double containment and leak detection systems for storage tanks, for both new and existing storage tank systems.

SUMMARY OF THE INVENTION

Accordingly, the present invention is directed to providing a means for double containment and leak detection that effectively and inexpensively satisfies EPA regulations and provides superior and safe control and detection of leaks from storage tanks. The present invention enables effective yet relatively inexpensive conversion of new or existing storage tanks to provide a secondary containment system that permits containing, accumulating, and detecting the presence of fluids or solids that might leak from the primary containment space in such tanks into a containment space provided by the present invention. The invention provides an apparatus including a tank, having a bottom and a surrounding shell, with the addition of a containment baffle means above the bottom and a leak detection means in a containment space between the containment baffle means and the tank bottom. (Most external corrosion failures in tanks occur at the tank base, which is generally inaccessible for inspection and subject to the greatest hydrostatic pressure.) The containment baffle means includes a baffle plate sealingly joined to the interior of the shell to form a sealed containment space between the containment baffle and the bottom. The present invention further provides for installing the leak detection means in the containment space to detect the presence of the stored material in the event it leaks into the containment space. The leak detection means is connected, through a leak-proof access, to means external to the tank for responding to such leaks of material so detected inside the containment space. The invention further includes a primary containment means, made of liner material, located inside the tank above the containment baffle means and within the shell, capable of containing such stored material. The invention further provides a method for converting existing tanks simply and inexpensively to incorporate the double containment and leak detection apparatus of the present invention into existing facilities.

These and various other characteristics and advantages of the present invention will become readily apparent to those skilled in the art upon reading the following detailed description and claims and by referring to the accompanying drawings.

BRIEF DESCRIPTION OF THE DRAWINGS

For a more detailed description of the preferred embodiment of the invention, reference is now made to the accompanying drawings, wherein.

DESCRIPTION OF THE PREFERRED EMBODIMENT

Modern chemical and manufacturing processes require storage of a variety of hazardous, dangerous, or otherwise undesirable materials. Concern for protection of the environment, awareness of health risks, and increasingly stringent regulations and laws dictate a need for improved protection against accidental or uncontrolled leakage of such materials from storage. In particular, Environmental Protection Agency regulations require that all storage systems, both new and existing, have or soon be equipped with secondary containment systems that are capable of collecting, accumulating, and detecting leakage of hazardous wastes from the primary containment system. The present invention, an embodiment of which is described below, is intended to provide apparatus for achieving such containment and detection of leaks from storage tank systems.

Figure 1:
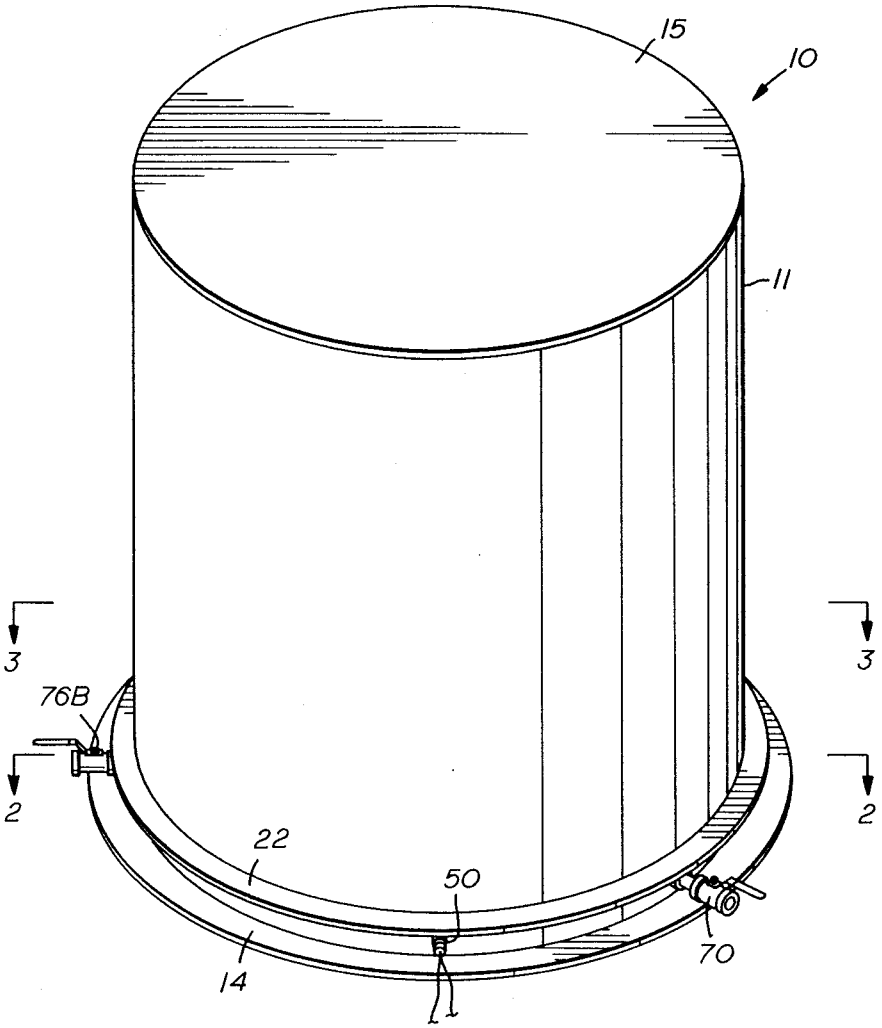
FIG. 1 shows an overall perspective view of a storage tank built in accordance with, and utilizing, the principles of the present invention (with various details omitted for clarity)

With reference to FIG. 1, there is shown therein a tank system 10 utilizing a double containment and leak detection apparatus built according to the present invention. The tank system 10 includes a tank body 11 having a shell 12 extending above a bottom 14. The shell 12 and bottom 14 are sealingly connected to form a container for storing, by way of example, liquids, in the embodiment shown. The present invention also is suitable for use on tanks for storing gases or solids, as the case may be. In the embodiment shown in FIG. 1, the tank system 10 includes a top 15 for covering the interior of the tank body 11. It is also within the scope of the invention to utilize a tank system 10 that lacks such a top 15, with containment and detection of leaks from the lower portions of the tank system 10.

Figure 2:
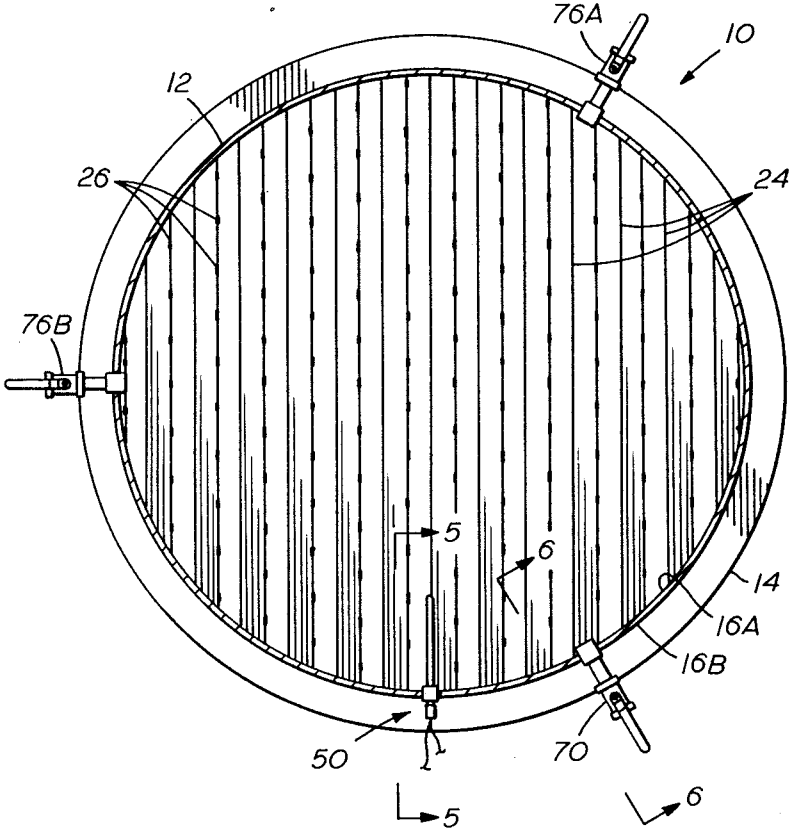
FIG. 2 shows a cross-sectional plan view of the tank shown in FIG. 1, viewed along the line 2—2 of FIG. 1.

Referring now to FIG. 2, there is shown therein a cross-sectional plan view along line A—A of FIG. 1, depicting various details omitted for clarity from FIG. 1. As can be seen in FIG. 2, the shell 12 is generally circular in cross-section, although another appropriate shape would be suitable for purposes of the present invention. The base of the shell 12 in the depicted embodiment rests on the upper surface 18 of the bottom 14. The junction between the shell 12 and the bottom 14 is sealed on the interior and exterior periphery by an interior weld 16A and a bottom exterior weld 16B, respectively, both of which are full-penetration welds and are shown in more detail in FIGS. 5 and 6, described below. With the shell 12 thus in continuous sealing contact with the bottom 14, the tank body 11 can hold materials within its interior. (Other elements depicted in FIG. 2 are discussed in more detail below.)

Figure 3:
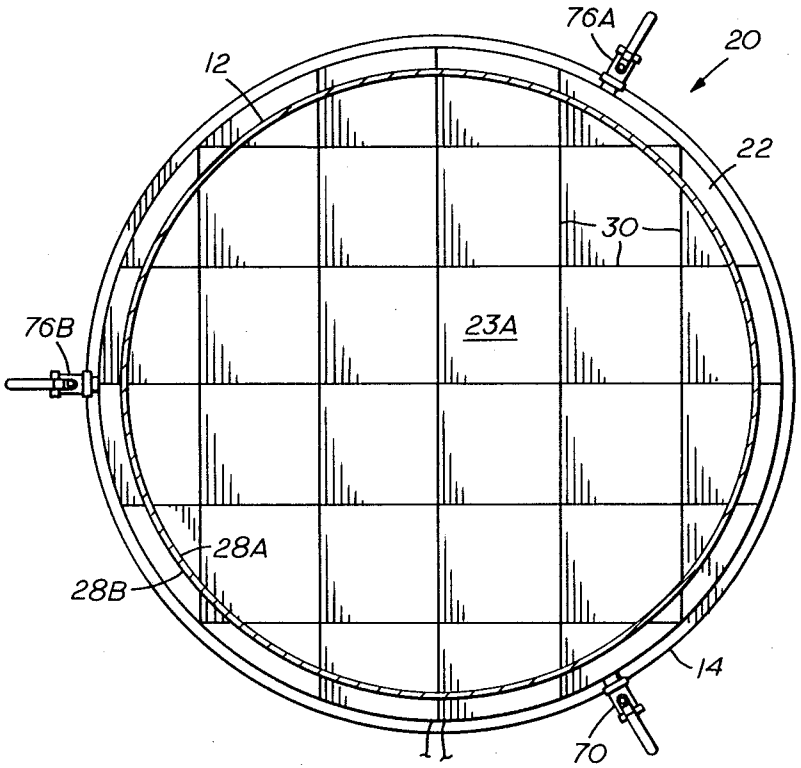
FIG. 3 shows a cross-sectional plan view of the tank shown in FIG. 1 viewed along the line 3—3 of FIG. 1.
Figure 5:
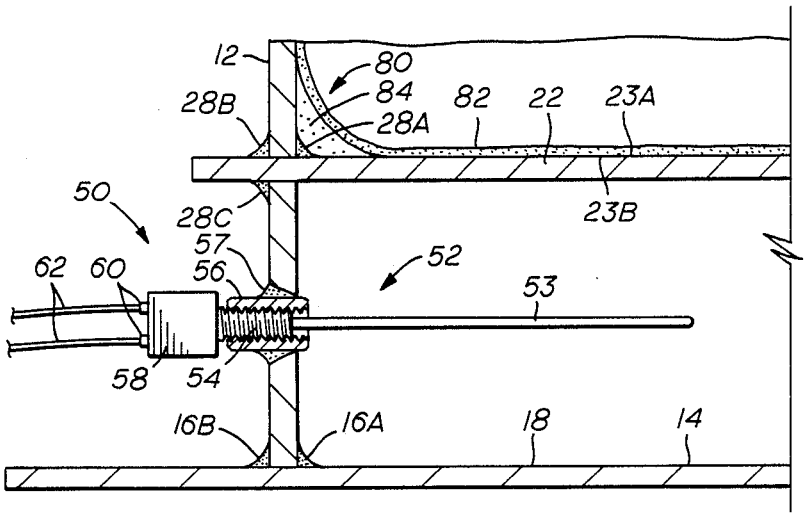
FIG. 5 shows a partial cross-sectional elevational view of a portion of the tank of FIG. 2, taken along line 5—5 in FIG. 2.
Figure 6:
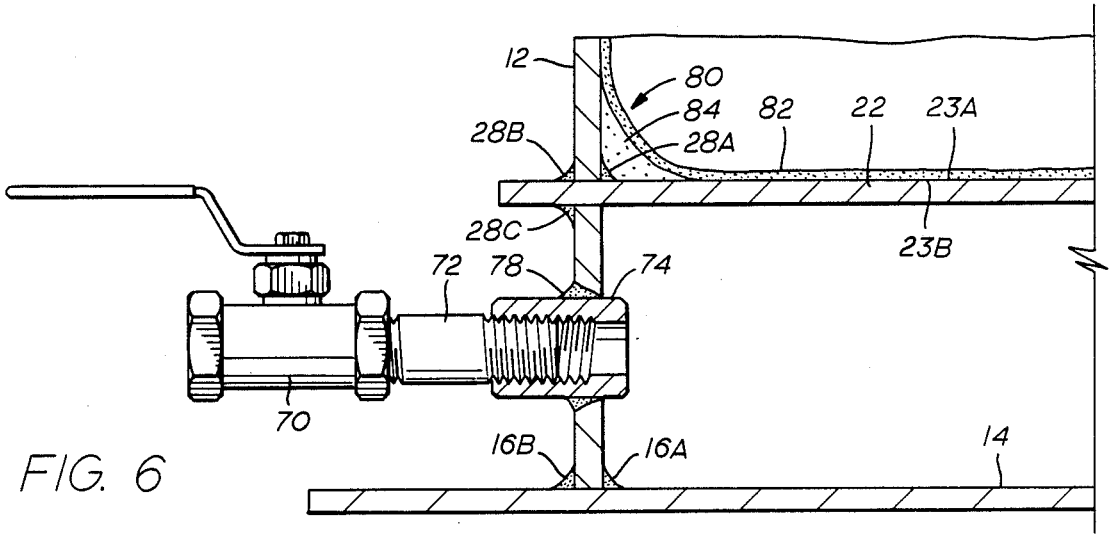
FIG. 6 shows a partial cross-sectional elevational view of a portion of the tank of FIG. 2, taken along the line 6—6 of FIG. 2.

With reference now to FIG. 3, there is shown therein a cross-sectional plan view taken through line B—B of FIG. 1, in which elements of the containment baffle means 20 of the present invention are shown. The shell 12, shown in cross-section, is generally perpendicular to and extends above a baffle plate 22, which is above and substantially parallel to the bottom 14, and has upper and lower surfaces 23A and 23B, respectively. The baffle plate 22 is in continuous sealing contact with the interior surface of the shell 12 by means of a baffle interior weld 28A disposed about the interior periphery of the shell 12 where it meets the baffle plate 22. In the embodiment shown, the baffle plate 22 extends outside the exterior of the shell 12, although such arrangement is not necessary for purposes of the present invention. (As discussed below, the embodiment depicted herein envisions insertion of the baffle plate 22 into an existing tank body which is facilitated by the particular construction of the baffle plate 22 shown.) In the embodiment depicted in FIG. 3, the baffle plate 22 is actually constructed from smaller plates joined together into one larger plate by means of interconnecting lap welds 30, some of which are depicted in FIG. 3. To ensure structural integrity and sealing contact, the baffle plate 22 is joined to the exterior of the shell 12 by welds between the exterior of the shell 12 and the portion of the baffle plate 22 extending outside the shell 12. Upper baffle exterior weld 28B, on the upper surface 23A of baffle plate 22, is shown in FIG. 3; lower baffle exterior weld 28C, on the lower surface 23B of baffle plate 22, and upper baffle exterior weld 28B are depicted in FIGS. 5 and 6, discussed below.

With reference again to FIG. 2, the embodiment described herein includes baffle supports 24 depending upon and fastened to the upper surface 18 of bottom 14 of the tank system 10. These baffle supports 24 provide structural support for the baffle plate 22 shown in FIG. 3. As shown in FIG. 2, a plurality of baffle supports 24 are disposed in generally parallel fashion on the upper surface of the bottom 14.

Figure 4:
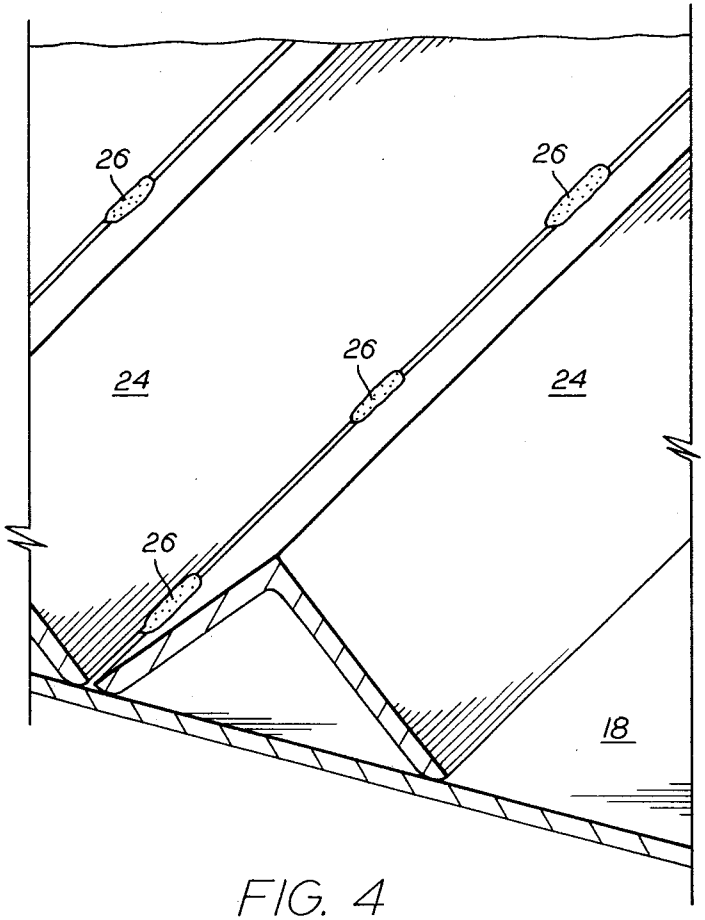
FIG. 4 shows a detailed perspective of a portion of the view of the tank shown in FIG. 2.

FIG. 4, which depicts a perspective view of a baffle support 24 on the upper surface 18 of the bottom 14 of the tank body 11, provides additional detail of the baffle support 24. By way of example only, an acceptable baffle support 24 for a variety of applications is a 3-inch by 3-inch by ¼-inch thick steel channel structural member placed in an inverted position, as shown in FIG. 4, on the upper surface 18 of the bottom 14. As shown in FIG. 4, each baffle support 24 sits on the upper surface 18 of the bottom 14 with opposite ends of each baffle support 24 located adjacent to points on the interior periphery of the shell 12. In addition, a plurality of support welds 26 of appropriate size and at appropriate intervals along the juncture of each side of the baffle support 24 channel member and the upper surface 18 of the bottom 14, as shown in FIGS. 2 and 4, fasten each baffle support 24 to the upper surface 18. It has been found that, for a variety of applications, support welds 26 in the form of fillet welds, each approximately 1-inch long, spaced at intervals of four feet on center along the length of baffle support 24 will be generally adequate to secure the baffle supports 24 during construction and thereby meet the purposes of the present invention. Since the baffle supports 24 provide structural support for the baffle plate 22, it will be readily seen by those skilled in the art that a variety of techniques and materials can be used to provide adequate structural support for the baffle plate 22, or other similar material, so long as the baffle plate 22 or the like is supported sufficiently to bear the weight of the materials to be stored within the tank body 11 without undue or impermissible stress or deflection. In certain instances, for example, the baffle plate 22 might be of sufficient structural strength to eliminate the need for any baffle supports 24. Accordingly, therefore, the containment baffle means 20 of the particular embodiment depicted herein can be altered or modified to meet the needs of a particular tank system 10, yet still be within the scope of the present invention.

The present invention provides for including a leak detection means 50 above the bottom 14 and below the baffle plate 22. With reference now to FIG. 5, which depicts a partial cross-sectional elevational view along the line C—C of FIG. 2 (with baffle supports 24 omitted for clarity), a fiber optic probe 52 extends through the wall of the shell 12 into a space designated the containment space located above the upper surface 18 of the bottom 14 and below the baffle plate 22. As shown in FIG. 5, the optic probe 52 has a probe tip 53 that extends into the containment space while the opposite end of the probe tip 53 joins a probe body 54 that extends through the shell 12 to the exterior of the tank body 11. A nipple 56 extends through a hole in the shell 12 and is secured by a circumferential weld 57 to the wall of the shell 12. The probe body 54 thus extends from the containment space in the interior of the shell 12 to the exterior of the shell 12. The welded connection provides a leak-proof seal on the exterior of the shell 12 around the outer periphery of the nipple 56. The probe body then joins a probe head 58 that contains a plurality of probe leads 60. Joining the probe leads 60 are connecting wires 62 that extend beyond the tank system 10 to an appropriate signaling, warning, process control, or other device capable of receiving and responding to signals transmitted by the fiber optic probe 52.

The preferred embodiment shown includes the fiber optic probe 52 for use in the leak detection means 50. One acceptable fiber optic probe 52 that can achieve the purposes of the present invention, and which is generally depicted in FIG. 5, is Levelite Model 12–575 available from Arizona Instrument Company of Jerome, Ariz. The fiber optic probe 52 detects the presence of material that leaks into the containment space by emitting and detecting an optical signal. The optical signal is emitted through a prism and the fiber optic probe 52 detects the refracted optical signal. When material is introduced into the containment space, the refractive index of the prism is altered, and hence the nature of the detected optical signal changes. The fiber optic probe 52 detects such change in the optical signal and sends an electrical signal in response to detecting such change. The electrical signal can be sent, for example, to a controller device (not shown), such as Levelite Model 11–540, also available from Arizona Instrument Company of Jerome, Ariz. The combination of the fiber optic probe 52 connected to the external controller, therefore, is able to detect and react to the presence of material, particularly fluids, that may leak into the containment space.

Other devices can serve as suitable leak detection means 50, besides the fiber optic probe 52 pictured in FIG. 5. For example, for detecting the hydrostatic pressure of fluids leaked into the containment space from the interior of the tank body 11, a suitable pressure-sensing device is Model M-3010 (Photo Helic) manufactured by Dwyer Instrument Co. of Michigan City, Ill. As another example, for detecting the presence of solids or gases within the containment space, a "sniffer" device such as Soil Sentry Twelve, available from Arizona Instrument Company of Jerome, Ariz., can be used to detect the presence of chemicals contained in certain materials in the containment space that are held in storage in the shell 12 above the baffle plate 22. Other devices would be suitable for use in the leak detection means 50 of the present invention in addition to those mentioned above, as will be apparent to those skilled in the art. For example, a float device could be installed inside the containment space to rise in the event fluid leaked into the space, and the float would send a signal in response to such rise by means of a float arm or other device, thereby serving to detect fluid leakage into the containment space and sending signals in response to such leakage. As additional examples, devices as simple as valves or sight glasses would enable visual or mechanical detection of the presence of liquids or gases in the containment space, and could thus be used in the leak detection means of the present invention.

As described in more detail below, the containment space, in normal operation, is to be empty of the material stored in the tank body 11. To purge the containment space of air or other materials that might otherwise interfere with the operation of the leak detection means 50, the present invention also includes purging the containment space with, for example, nitrogen. FIG. 6 depicts a partial cross-sectional elevational view along line D—D of FIG. 2 (with the baffle supports 24 again omitted for clarity). A fill valve 70, outside the tank, suitable for attachment to an exterior source of purging gas such as nitrogen, connects to a pipe 72 extending into a nipple 74 that is inserted and secured in a hole through the shell 12. The nipple 74 is secured to the hole in the shell 12 by a circumferential weld 78 that seals between the exterior periphery of the nipple 74 and the outside of the shell 12 to provide a leak-proof connection from the containment space inside the shell 12, through the nipple 74, through the pipe 72, and into the fill valve 70. The fill valve 70 can thus be connected to an external source of nitrogen (not shown), for example, for purging the containment space and filling it with nitrogen. To aid in the process, with reference to FIG. 2, the embodiment depicted includes two relief valves 76A and 76B. The relief valves 76A, 76B are connected to the containment space through the shell 12 in a fashion similar to that shown in FIG. 6 for the fill valve 70.

Referring again to FIG. 6, a primary containment means 80 is installed inside the tank body 11 within the shell 12 and above the baffle plate 22. The primary containment means 80 includes a liner 82 applied to the interior of the tank body 11. While those skilled in the art will know that a variety of materials can be used to form the liner 82, some of the acceptable materials that are suitable for the purposes of the present invention include phenolic, epoxy phenolic, vinyl ester, vinyl ester with glass roving, epoxy novalac, and epoxy with chopped fiberglass. As shown in FIG. 6, for abrupt changes in the interior surfaces of the tank body 11, such as where the interior of the shell 12 joins the upper surface 23A of the baffle plate 22, a layer of caulk 84 under the liner 82 provides a uniform and gradual transition over such irregular areas. Other locations where such caulk 84 might be useful include the lap welds 30 shown in FIG. 3, as well as all other welded seams, bolt heads, or other projections on the interior of the tank body 11.

Figure 7:
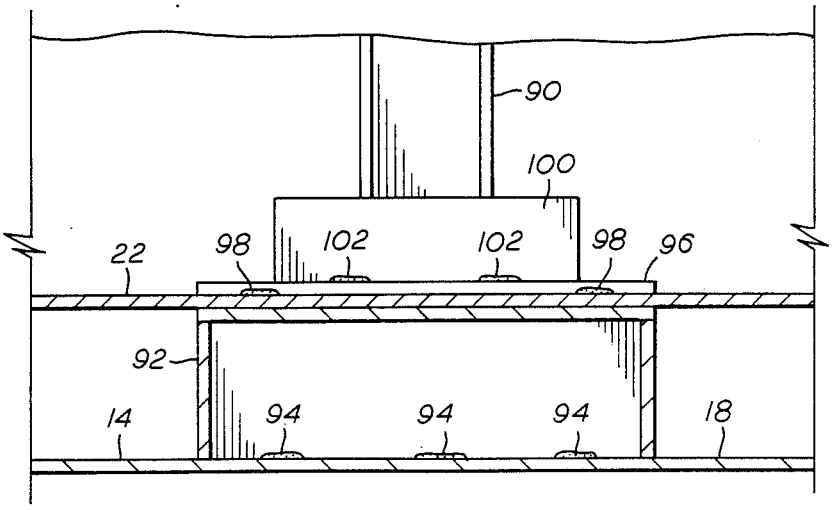
FIG. 7 shows an elevational view of a portion of a support that can be utilized in the embodiment of the tank shown in the preceding figures.

FIG. 7 depicts a portion of an optional element for use in the embodiment of the tank system 10 shown in the figures discussed above. FIG. 7 depicts a support column 90, contained within the tank body 11, used to support a roof 15 or other item such as a steam coil, piping, or other permanent fixture, contained within the tank system 10. In the absence of the present invention, a support column 90 would have at its upper end (not pictured) the item being supported, and the base of the column would rest on the bottom 14 or on a support base which, in turn, would sit on the bottom 14. To install the containment baffle means 20 so as to provide a containment space below the baffle plate 22 and above the bottom 14, in accordance with the present invention, the support has to be modified as shown in FIG. 7. Accordingly, a support box 92 is installed on the upper surface 18 of the bottom 14 and secured by a plurality of support box welds 94 distributed around the periphery of the support box 92 and securing it to the upper surface 18 of the bottom 14. A support base 100 in turn rests on the support plate 96, and the two are secured together by a plurality of support base welds 102. Finally, the support column 90 is connected to the support base 100, by welding, bolting, or otherwise, securing the support column 90 to the support base 100. The roof or other item supported by the support column 90, therefore, rests on top of the support column 90, as had been the case before installation of the present invention. In addition, and in the alternative, if purity of the material stored in the tank system 10 is of concern, and the support column 90 and the like contained within the tank body 11 are to be coated, the support base 100 can be welded directly to the baffle plate 22 and the support plate 96 can be eliminated. For this alternative construction, the liner 82 would be applied to the support base 100 and the support column 90, as well as the shell 12 and the baffle plate 22.

The present invention permits installing the double containment and leak detection apparatus on new or existing tanks or vessels. If a new tank is used, it should preferably be hydrostatically tested before installing the containment baffle means 20, to ensure the pressure integrity of such tank. If an existing tank is used, it should be inspected and repaired to the extent necessary to ensure its pressure integrity. Before installing any baffle supports 24 or other materials on the bottom 14, the bottom 14 should be lightly sandblasted to allow for thorough inspection. If any defects are found, they should be repaired by welding any holes that are found or by welding steel plates over badly pitted areas. Then, as described above, baffle supports 24 of equal height and adequate structural strength are to be installed at appropriate spacing and secured to the tank bottom 14. If present, the support base 100 below the support column 90 should be cut sufficiently above the height at which the baffle plate 22 will be installed to allow for the items depicted in FIG. 7 to be installed below the bottom of the support column 90. One or more holes should then be drilled in the wall of the shell 12 to allow a nipple 56 to be inserted and welded for a leak-proof connection between the interior and exterior of the shell 12 after the fiber optic probe 52 is inserted through the nipple 56 and secured therein. As shown in FIG. 5, the holes for the nipples 56 are to be located in what will be the containment space above the bottom 14 and below the baffle plate 22. Additional holes should be drilled and nipples 74 installed, as shown in FIGS. 2 and 6, to provide for installation of the fill valve 70 and relief valves 76A, B.

Next, for an existing tank body 11, to install the baffle plate 22, slots are out into the shell of the tank to permit portions of the baffle plate 22 to be inserted through the wall of the shell 12. As shown in FIGS. 3, 5, and 6, the portions of the baffle plate 22 extending through the wall 12 are sealingly joined to the shell by means of a baffle interior weld 28A on top of the baffle plate 22 inside the shell 12, and two baffle exterior welds 28B, C on top and bottom, respectively, of the baffle plate 22 outside the shell 12. Preferably, the baffle plate 22 outside the shell 12 should be cut and ground smooth about the circumference of the tank body 11, as shown in FIGS. 5 and 6. The individual portions that make up the complete baffle plate 22 should be laid in place and welded together with lap welds 30, as shown in FIG. 3, to form a solid, continuous sealing surface across the interior of the tank body and in continuous sealing contact around the inner periphery of the shell 12. After the baffle plate 22 is installed above a support box 92, the pre-coated support plate 96 can be set in place over the support box 92 onto the upper surface 23A of the baffle plate 22 and secured thereto by a plurality of support plate welds 98. The support base 100, sized to fit over the support plate 96, is then to be installed and secured by a plurality of support base welds 102. The support base 100 and support column 90 can then be installed, by welding or otherwise.

The primary containment means 80 is then applied throughout the interior of the tank body 11. As shown in FIG. 6, for example, caulk 84 and liner 82 materials are applied to irregularities and abrupt or sharp changes in shape throughout the interior of the tank body such as at the junctions of the interior of the shell 12 and the upper surface 23A of the baffle plate 22, the baffle plate 22 and support plate 96, and the support plate 96 and support base 100. Also as noted above, in the alternative, if the entire interior of the tank system 10 is to be coated to maintain product purity, the pre-coated support plate 96 can be eliminated, with the support base 100 welded directly to the baffle plate 22 and caulk 84 and liner 82 applied over the adjoining surfaces. Before applying the liner 82, all welding flux, weld splatter, sharp metal projections, and laminations should be ground smooth. Air conditions or dehumidifiers should be used to assure that the temperature in the tank is between 75°-105° F., with relative humidity below 30%. All oil, grease, and other deleterious matter should be removed by chemical cleaning in accordance with the Structural Steel Painting Council standard SSPC-SP-1, as needed. All old surfaces to be coated with liner 82 or caulk 84 should be blast cleaned to a white metal finish in accordance with SSPC-SP-5. The blastcleaned surfaces should have a uniform dense anchor pattern with irregularly shaped peaks or valleys, having an overall depth of 2.5 to 3.0 mils. All dust and other foreign matters should be removed from the blastcleaned surfaces by vacuum cleaning. The caulk 84 should then be applied to provide a uniform gradual transition on all sides of irregularly shaped or projecting surfaces, including weld seams, bolt heads, and lap joints. Total thickness of the caulk 84 should be approximately 50 mils. The appropriate liner 82 should be applied in accordance with the properly prescribed application procedure as will be readily known to those skilled in the art. Finally, the liner 82 and other coating systems applied to steel surfaces should be inspected with appropriate holiday detectors. Any items supported by support columns 90 should be replaced and the tank top 15, if any, reinstalled.

As described above and shown in the accompanying drawings, the present invention thus provides a double containment and leak detection system capable of satisfying EPA regulations. The liner 82 forms a primary containment system. The tank body 11, including the shell 12, the baffle plate 22, and the bottom 14, forms a secondary containment system surrounding the liner 82. This arrangement thus satisfies the requirement for a secondary containment system under the EPA regulations. In addition, the sealed containment space below the baffle plate 22 and above the bottom 14 provides for collecting and accumulating releases of materials from the primary containment means 80 within the tank body 11. The leak detection means 50 within the containment space enables rapid and effective detection of the leaks materials from within the liner 82 into the containment space. The containment space, normally filled with nitrogen or some other relatively inert gas, will receive material that might leak from the primary containment means 80 and through the baffle plate 22. The leak detection means 50, designed to detect whatever material is stored within the tank system 10, will immediately sense the presence of such material within the containment space and send the appropriate signal through the connecting wires 62 to an alarm system, a control system, or some other device, thereby allowing immediate detection of leaks and thus far exceeding the 24-hour requirement for detecting leaks under the EPA regulations. The present invention, therefore, provides effective means of attaining and detecting leaks of hazardous materials from tank storage systems, it is inexpensive and relies on proven technology, for both new and existing installations.

Those skilled in the art will appreciate that the foregoing list of attributes and advantages is not exhaustive of the features of the present invention. It will be appreciated that modifications to the described preferred embodiment of the invention can be made without departing from the substance and spirit of the present invention. In light of the foregoing, therefore, it will be seen that the scope of the present invention, as claimed below, exceeds that described in the preceding description of the preferred embodiment.

What is claimed is:

1. A method for modifying a tank to allow containing and detecting leakage of stored material held in such tank, comprising the steps of:

(a) Providing a tank having a tank bottom and a shell extending above the tank bottom, and being capable of containing such stored material inside the tank above the tank bottom and within the shell;

(b) Placing a leak detection means in the tank above the tank bottom, such leak detection means being capable of detecting and sending signals in response to the presence of such stored material;

(c) Installing a leak-proof access to the leak detection means from outside the tank; and (d) Assembling a containment baffle in the tank within the shell above the leak detection means, such containment baffle including a continuous sealing surface in continuous sealing contact with the shell, for sealingly isolating a space above the tank bottom and below the containment baffle and that contains the leak detection means.

2. The method of claim 1, further comprising the step of constructing a primary containment means within the tank, above the tank bottom and inside the shell.

3. The method of claim 2, wherein the primary containment means includes a liner applied to the interior of the tank.

4. The method of claim 1, wherein the containment baffle includes a plurality of baffle plates and said step of installing the containment baffle includes cutting slots through the shell, inserting a baffle plate through such slots, sealingly joining each baffle plate to the shell at the slot where such plate is inserted, and joining each such plate to each adjacent plate to form the containment baffle.

5. The method of claim 1, and further including the step of fastening a baffle support onto the tank bottom before placing the containment baffle in place, wherein such baffle support elevates the containment baffle to leave a space between the tank bottom and the containment baffle.

6. The method of claim 5, wherein the baffle support is a channel structural member.

7. The method of claim 1, further including the step of connecting the leak detection means to a device external to the tank capable of receiving and responding to signals from the leak detection means.

8. The method of claim 1, wherein the leak detection means includes a fiber optic probe.

9. The method of claim 1, wherein the leak detection means includes a device for sensing hydrostatic pressure.

10. The method of claim 1, wherein the leak detection means includes a device for detecting the presence of predetermined chemicals.

* * * * *